US008151890B2

(12) United States Patent
Spencer et al.

(10) Patent No.: US 8,151,890 B2
(45) Date of Patent: Apr. 10, 2012

(54) SYSTEM, METHOD AND APPARATUS FOR A MODULAR PRODUCTION TREE ASSEMBLY TO REDUCE WEIGHT DURING TRANSFER OF TREE TO RIG

(75) Inventors: David N. Spencer, Kemnay (GB); Michael A. Wenham, Kintore (GB); Paul W. White, Banchory (GB)

(73) Assignee: Vetco Gray Inc., Houston, TX (US)

( * ) Notice: Subject to any disclaimer, the term of this patent is extended or adjusted under 35 U.S.C. 154(b) by 661 days.

(21) Appl. No.: 12/258,669

(22) Filed: Oct. 27, 2008

(65) Prior Publication Data

US 2010/0101799 A1 Apr. 29, 2010

(51) Int. Cl.
*E21B 23/00* (2006.01)

(52) U.S. Cl. ..... 166/352; 166/336; 166/344; 166/360; 166/365; 166/250.01

(58) Field of Classification Search ..... 166/352, 166/336, 337, 339–341, 344, 351, 360, 365, 166/368, 250.01, 377–379, 381, 85.1
See application file for complete search history.

(56) References Cited

U.S. PATENT DOCUMENTS

| | | | | |
|---|---|---|---|---|
| 4,438,817 | A * | 3/1984 | Pokladnik et al. | 166/341 |
| 4,629,003 | A * | 12/1986 | Baugh | 166/341 |
| 4,732,215 | A * | 3/1988 | Hopper | 166/366 |
| 4,848,475 | A * | 7/1989 | Dean et al. | 166/357 |
| 4,899,822 | A * | 2/1990 | Daeschler et al. | 166/339 |
| 5,025,865 | A * | 6/1991 | Caldwell et al. | 166/366 |
| 5,192,167 | A * | 3/1993 | da Silva et al. | 405/195.1 |
| 5,299,641 | A * | 4/1994 | Paulo et al. | 166/341 |
| 5,310,006 | A * | 5/1994 | Freitas et al. | 166/339 |
| 6,408,949 | B1 * | 6/2002 | Aquilera et al. | 166/368 |
| 6,460,621 | B2 * | 10/2002 | Fenton et al. | 166/347 |

(Continued)

FOREIGN PATENT DOCUMENTS

EP 0480772 A1 4/1992

(Continued)

OTHER PUBLICATIONS

A. Fletcher, et al. "Modularization of Trees", Jan. 1, 1987, Ocean Science and Offshore Engineering, vol. 10 Modular Subsea Production Systems.

*Primary Examiner* — Thomas Beach
*Assistant Examiner* — Matthew Buck
(74) *Attorney, Agent, or Firm* — Bracewell & Giuliani LLP

(57) ABSTRACT

A modular tree production tree assembly reduces the weight during transfer of the tree components from a barge to a production rig. The tree assembly includes an upper tree module, a lower tree module, and a choke bridge module. The upper tree module has a tree head, the lower tree module has a guidance system and ties in the flow lines to the in-field infrastructure, and the choke bridge module has the choke and instrumentation bridge to link the three components together. Prior to delivery to the rig, the components of the modular tree assembly may be joined together and tested on shore. Upon arrival at the rig, the components are individually lifted from the barge onto the rig by a crane. After the tree components are on the rig, the modular tree is reassembled and then deployed to the sea floor via the draw works.

19 Claims, 10 Drawing Sheets

U.S. PATENT DOCUMENTS

| | | | | |
|---|---|---|---|---|
| 6,494,268 | B1 * | 12/2002 | Ljungdahl et al. | 166/379 |
| 6,644,410 | B1 * | 11/2003 | Lindsey-Curran et al. | 166/360 |
| 6,698,520 | B2 * | 3/2004 | Fenton et al. | 166/347 |
| 6,763,890 | B2 * | 7/2004 | Polsky et al. | 166/360 |
| 6,998,724 | B2 * | 2/2006 | Johansen et al. | 290/1 R |
| 7,048,058 | B2 * | 5/2006 | Ostergaard | 166/339 |
| 7,073,592 | B2 * | 7/2006 | Polsky et al. | 166/360 |
| 7,201,229 | B2 * | 4/2007 | White et al. | 166/368 |
| 7,520,989 | B2 * | 4/2009 | Ostergaard | 210/512.1 |
| 7,647,974 | B2 * | 1/2010 | Fenton | 166/368 |
| 7,740,074 | B2 * | 6/2010 | White et al. | 166/347 |
| 7,770,651 | B2 * | 8/2010 | Krehbiel et al. | 166/357 |
| 7,845,404 | B2 * | 12/2010 | McStay et al. | 166/250.01 |
| 2002/0070026 | A1 | 6/2002 | Fenton et al. | |
| 2003/0221835 | A1 | 12/2003 | Polsky et al. | |
| 2004/0251030 | A1 * | 12/2004 | Appleford et al. | 166/357 |
| 2008/0023204 | A1 | 1/2008 | Fenton | |
| 2009/0025936 | A1 * | 1/2009 | Donald et al. | 166/344 |
| 2009/0277644 | A1 * | 11/2009 | McStay et al. | 166/336 |
| 2010/0025034 | A1 * | 2/2010 | Donald et al. | 166/267 |
| 2010/0044038 | A1 * | 2/2010 | Donald et al. | 166/267 |
| 2010/0200241 | A1 * | 8/2010 | Ward | 166/341 |
| 2010/0300700 | A1 * | 12/2010 | Garbett et al. | 166/368 |

FOREIGN PATENT DOCUMENTS

| | | | |
|---|---|---|---|
| EP | 0527618 | A1 | 2/1993 |
| WO | WO 96/06260 | A1 | 2/1996 |
| WO | WO 00/47864 | A1 | 8/2000 |

* cited by examiner

SYSTEM, METHOD AND APPARATUS FOR A MODULAR PRODUCTION TREE ASSEMBLY TO REDUCE WEIGHT DURING TRANSFER OF TREE TO RIG

BACKGROUND OF THE INVENTION

1. Technical Field

The present invention relates in general to production trees for subsea oil wells and, in particular, to an improved system, method and apparatus for a modular production tree assembly for reducing weight during transfer of the tree from a barge to a rig.

2. Description of the Related Art

A conventional subsea wellhead assembly includes a wellhead housing that supports one or more casing hangers located at upper ends of strings of casing extending into the well. A production tree or "tree" is landed on the wellhead for controlling the production of well fluids. The tree usually carries a choke and valves to control the flow and sensors to monitor the flow.

Trees are cumbersome and very heavy. Prior to the installation of a tree on the sea floor, it must be delivered to the offshore rig at sea and hoisted onto the rig platform. The size and weight of trees makes it difficult to lift them from a delivery barge onto the rig. In order to lift larger trees onto the rig, they must be broken down into their various components and then reassembled and retested prior to deployment.

Deployment may require a flowbase to be guided onto the wellhead and then the tree guided to the well and flow base to align the flowline connections. In shallow water this is traditionally done with wires, such as a 5-leg sling set made up to the tree frame. This adds weight to the design as the frame must be suitably strengthened. In deep water a guideline-less approach is normally used, such as a lift cap with a single leg sling that is clamped or dogged to the tree mandrel.

In addition, some form of a guide funnel is normally required between the tree and the flowbase and/or wellhead. This configuration also adds weight and complexity to the overall assembly. A choke bridge may be used to connect a tree to a template, or be integral with the tree which may require an additional pipe spool and hydraulic connection to make up to a flowbase in the case of satellite trees. This again requires additional connections adding weight and complexity. Although these solutions are workable, an improved design that overcomes the limitations and expense of prior art designs would be desirable.

SUMMARY OF THE INVENTION

Embodiments of a system, method, and apparatus for a modular production tree assembly to reduce the weight during transfer of the tree components from a barge to a rig. The tree assembly may comprise three modules, including an upper tree module, a lower tree module, and a choke bridge module. In one embodiment, the upper tree module comprises the tree head, the lower tree module comprises the guidance system and a means of tying in the flow lines to the in-field infrastructure, and the choke bridge module comprises the choke and instrumentation bridge to link the three components together.

Prior to delivery to the rig, the components of the modular tree assembly may be joined together and tested on shore. The tree is then loaded onto a barge or other delivery vessel in its assembled state, or disassembled prior to delivery. Upon arrival at the rig, the components are individually lifted from the barge onto the rig by a standard outrigger crane. Since outrigger cranes typically have a lift limit of 40 tons or less, lifting the modular components is far more manageable compared to prior art techniques.

After the tree components are on the rig, the modular tree is reassembled. Advantageously, only interface tests, such as self-alignment (i.e., no bolted connections, single bore test) are required for what is required to make up the components after loading them onto the rig. The entire tree assembly is then deployed to the sea bed with the draw works on the rig. In some embodiments, the tree assembly is not designed to be recovered after it is deployed on the sea bed.

In one embodiment of the invention, the modular tree assembly comprises the upper tree module having the treehead assembly, wellhead connector, control system (e.g., SCM/SCMMB) and support frame work (with integral guideline or guideline-less interfaces). The lower tree module comprises a guideline-less, downward-facing funnel to interface with the wellhead, a manifold/flowline connection system, and associated pipe work for connection to the upper tree via the choke bridge module. The choke bridge module carries all the appropriate sensors, flow meters and choke components. These are operated from the upper tree module when the choke bridge assembly is connected between the upper and lower tree modules, to provide an integrated tree system.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Referring to FIGS. 1-13, embodiments of a system, method and apparatus for a modular production tree assembly to reduce the weight during transfer of the tree components from a barge to an offshore rig are disclosed. The tree assembly 21 (see, e.g., FIG. 1) may comprise only three modules, including an upper tree module 23, a lower tree module 25, and a choke bridge module 27. This design greatly simplifies the assembly and transportation of the tree when it is deployed to the rig.

Figure 1:
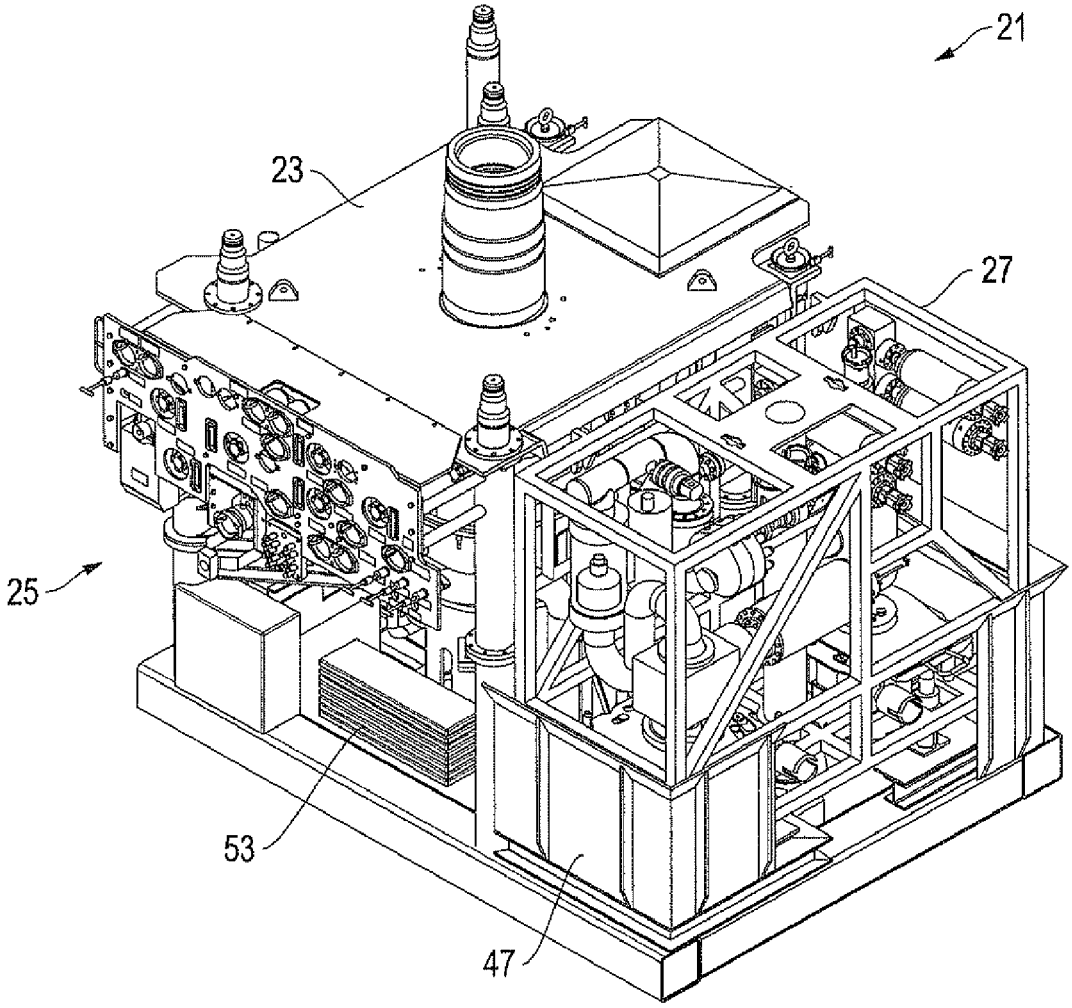
FIG. 1 is an isometric view of one embodiment of a modular production tree assembly and is constructed in accordance with the invention.
Figure 2:
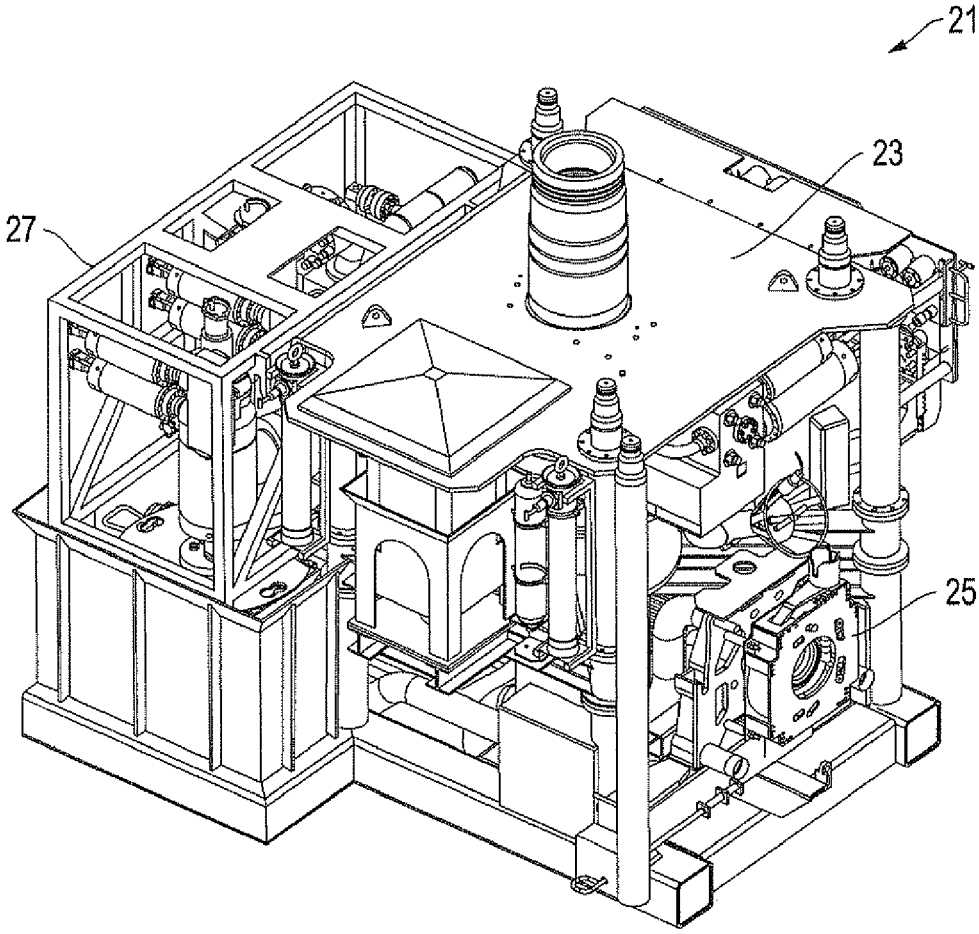
FIG. 2 is a reverse isometric view of the modular production tree assembly of FIG. 1 and is constructed in accordance with the invention.
Figure 3:
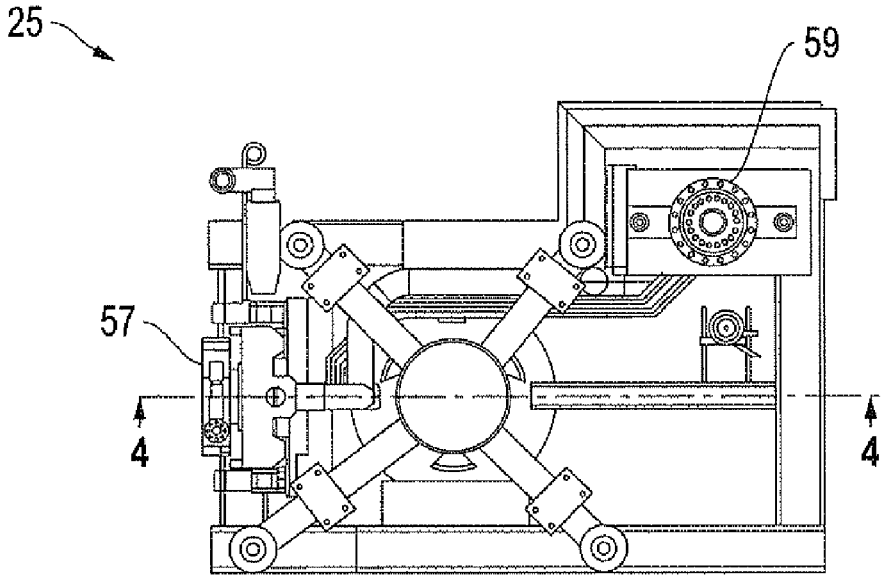
FIGS. 3-6 are top, sectional, side and isometric views of one embodiment of a lower tree for the modular production tree assembly of FIG. 1 and is constructed in accordance with the invention.
Figure 4:
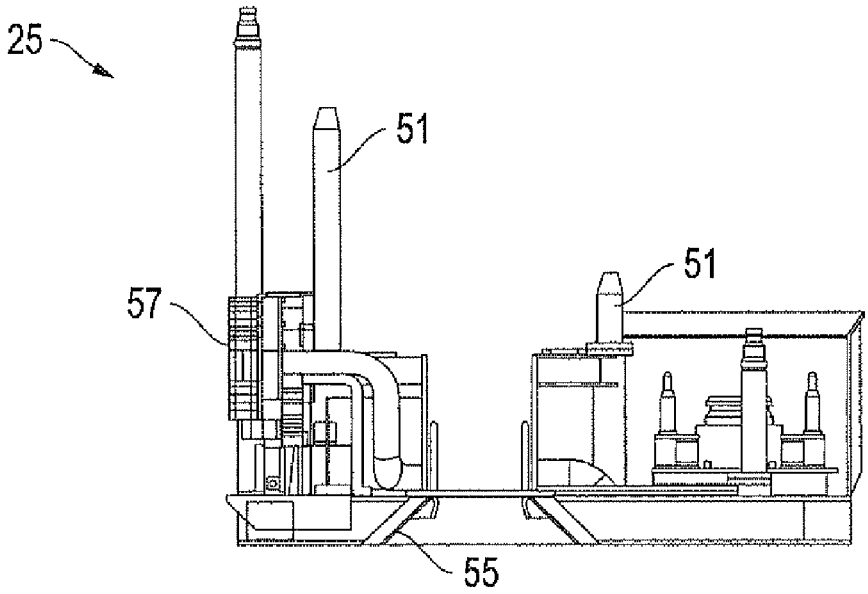
Figure 5:
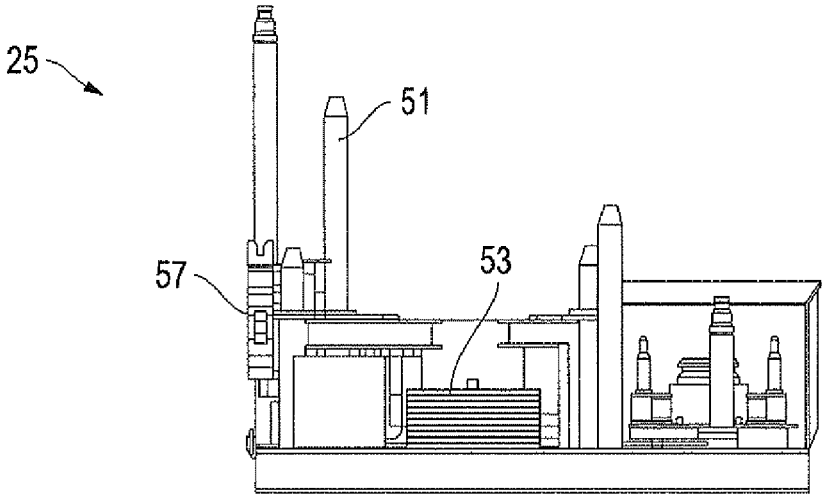
Figure 6:
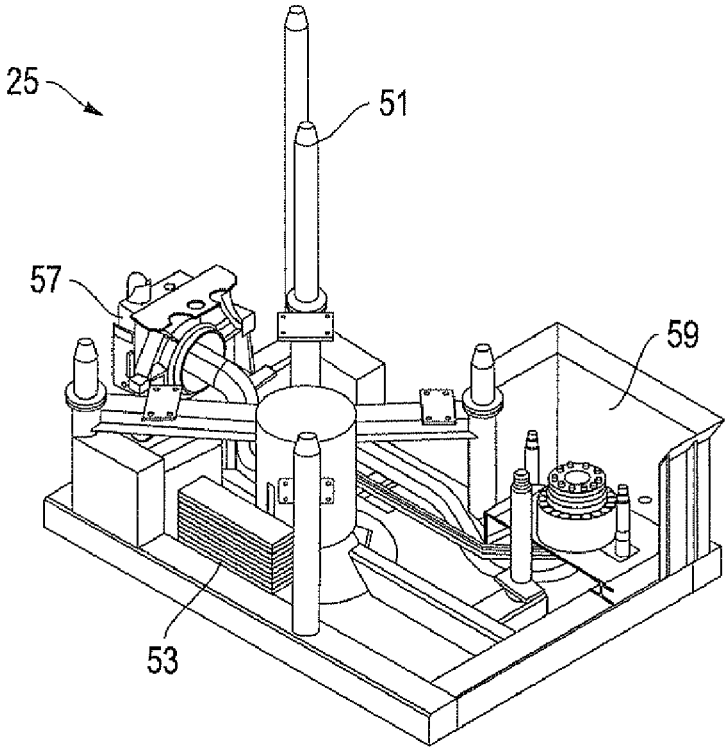
Figure 9:
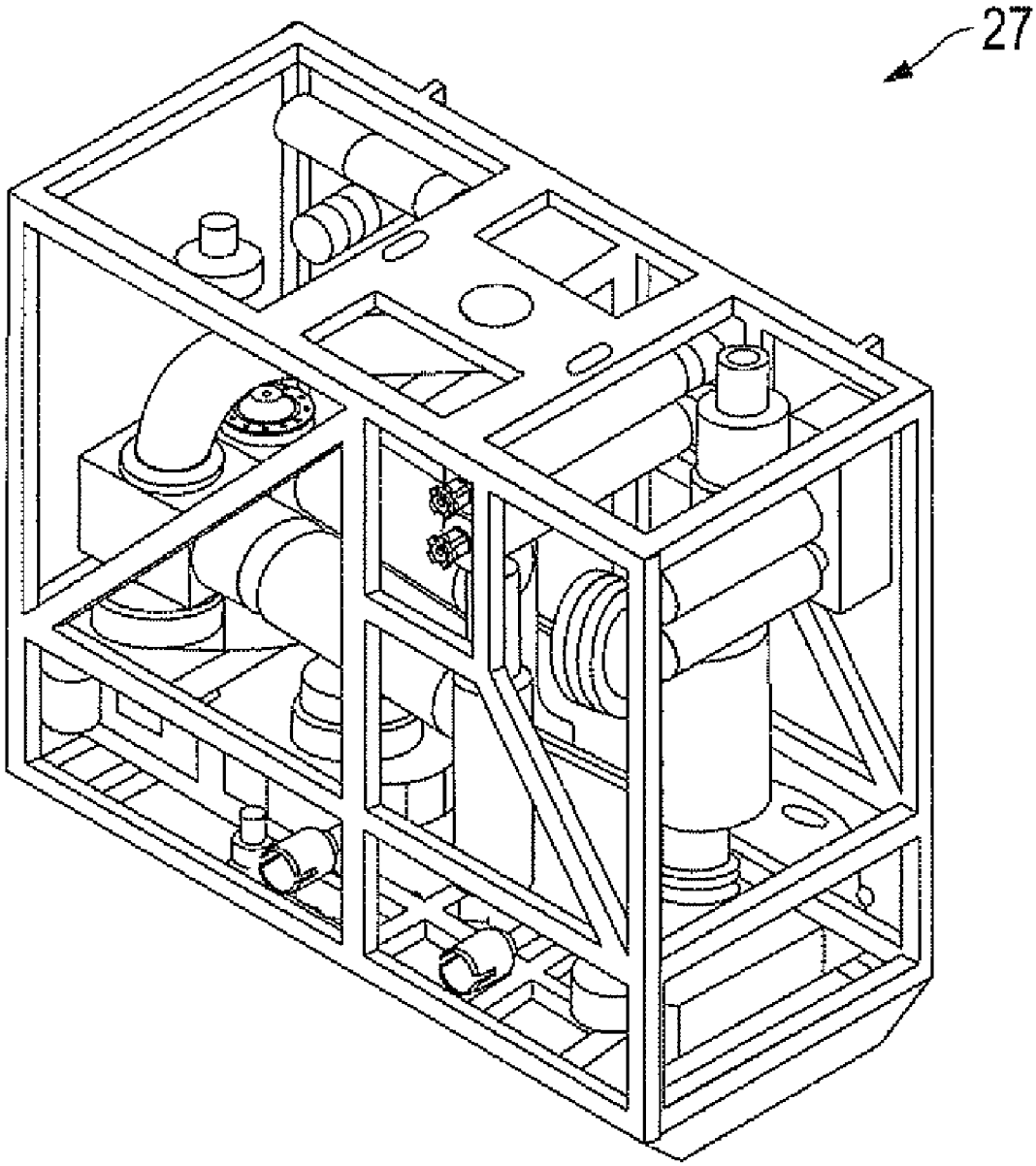
FIGS. 9-11 are isometric, front and side views of one embodiment of a choke bridge for the modular production tree assembly of FIG. 1 and is constructed in accordance with the invention.
Figure 11:
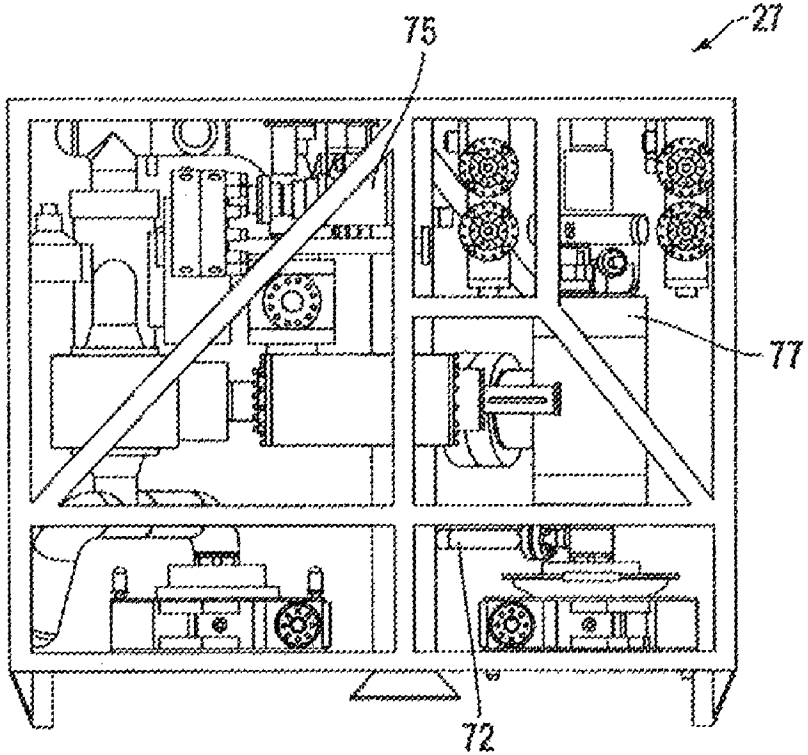
Figure 10:
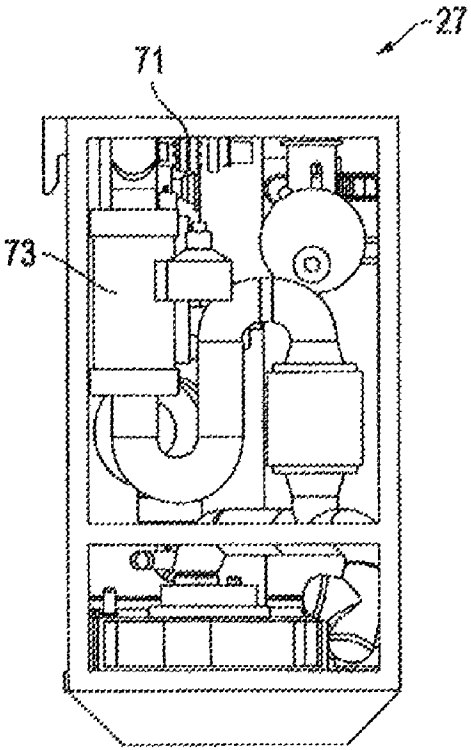

In one embodiment, the invention comprises a method of deploying a production tree, such as the tree 21 shown in FIGS. 1 and 2. The method comprises providing the modular production tree assembly 21 with a plurality (e.g., only three) modules, including an upper tree module 23 (FIGS. 7 and 8), a lower tree module 25 (FIGS. 3-6), and a choke bridge module 27 (FIGS. 9-11).

Figure 12:
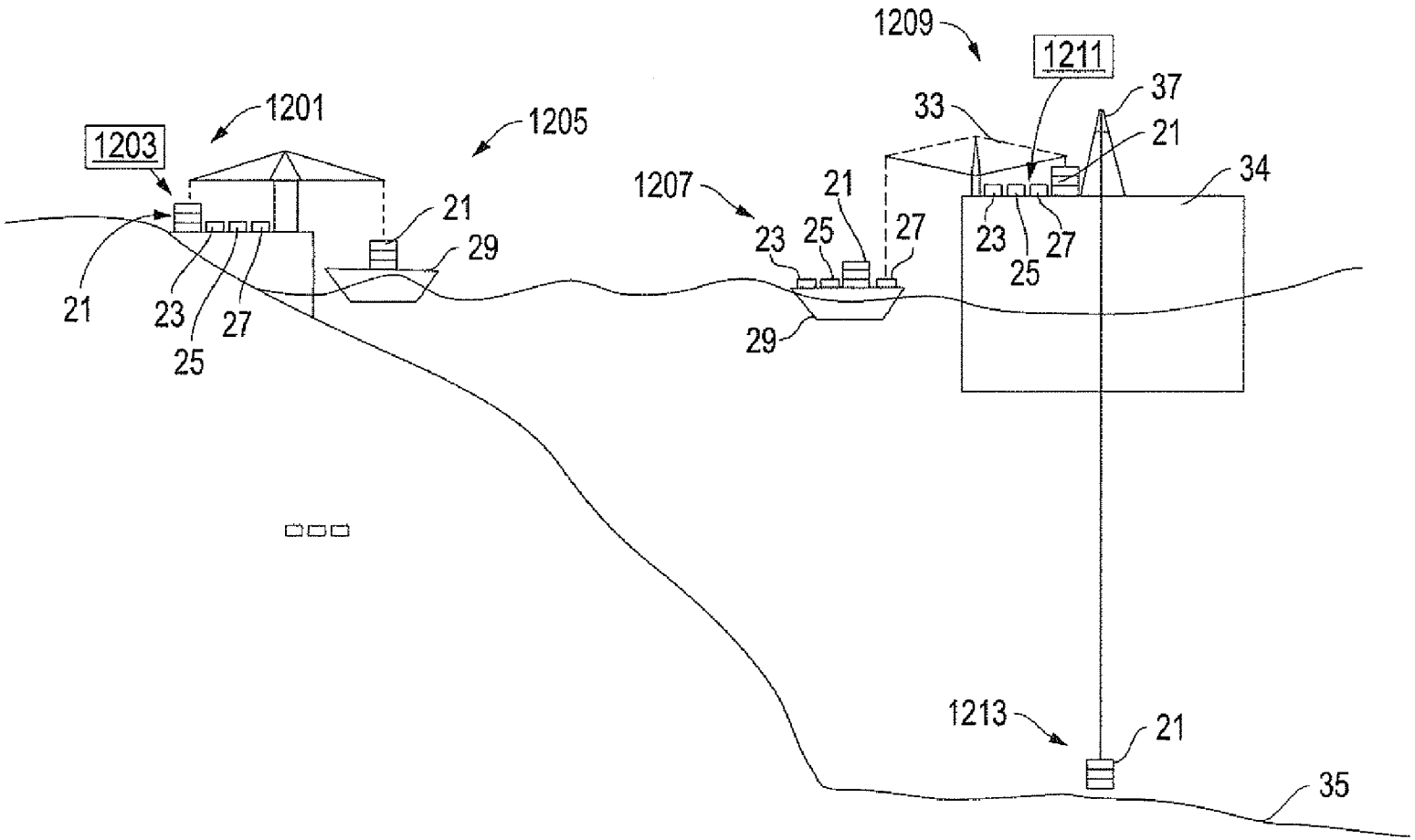
FIG. 12 is a schematic diagram of one embodiment of deploying a production tree and is constructed in accordance with the invention.
Figure 13:
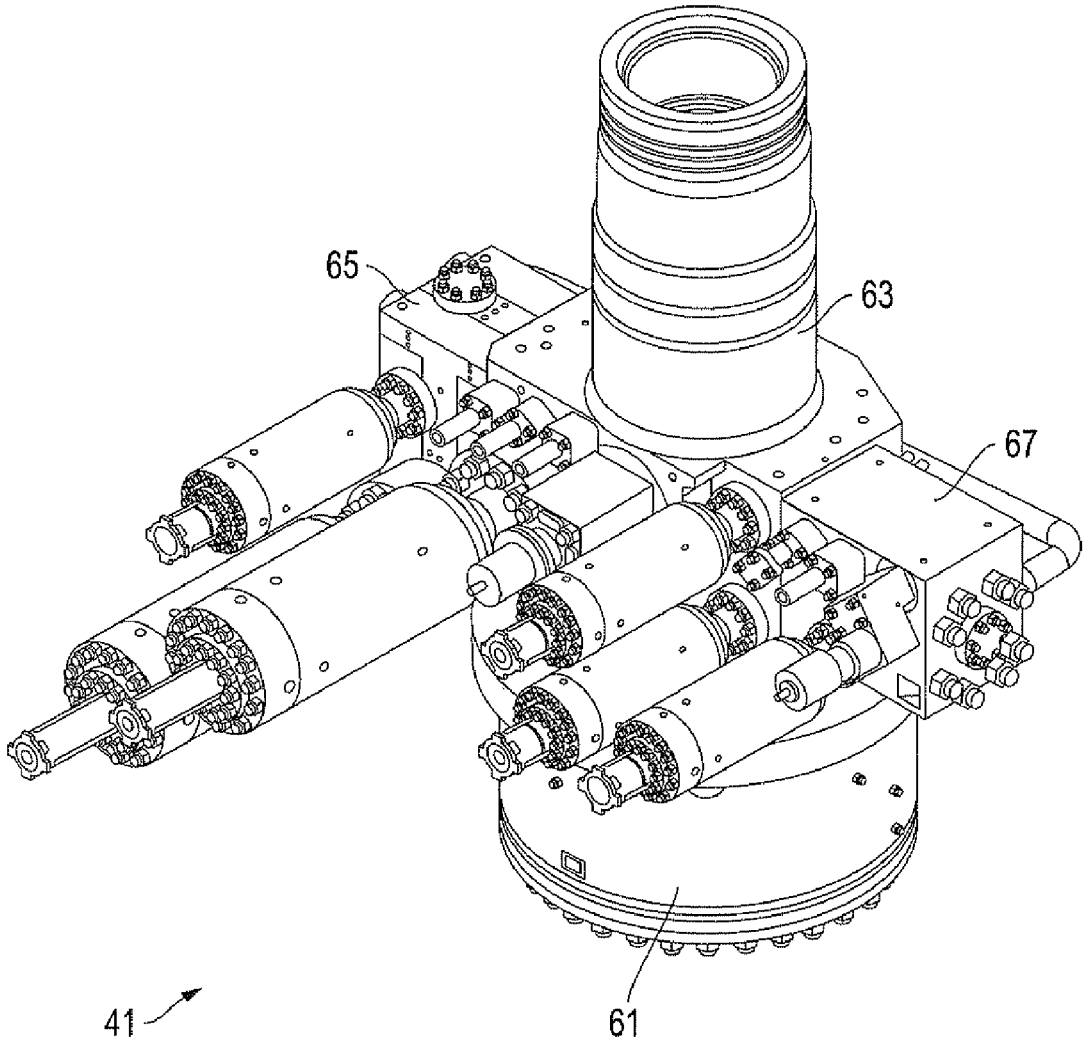
FIG. 13 is an isometric view of one embodiment of a treehead constructed in accordance with the invention.

As shown schematically in FIG. 12, one embodiment of the method comprises assembling the upper tree module 23, lower tree module 25, and choke bridge module 27 on land to form the tree assembly 21 (step 1201), and testing the modular production tree assembly (step 1203) while it is on land. The tested tree assembly 21 is placed on a sea vessel 29 (e.g., a barge) and transported (step 1205) to an offshore rig 34. Alternatively, the tree assembly 21 may be disassembled on land after testing 1203, and placed on the barge 29 as the individual modules 23, 25, 27 before the barge departs for the rig.

After barge 29 delivers the tree assembly 21 or disassembled modules 23, 25, 27 to rig 34 (step 1207), a first crane (e.g., outrigger lift) 33 mounted to the rig 34 is used to separately lift the separate modules 23, 25, 27 onto the rig 34 (step 1209). Crane 33 typically has a limited lift capacity (e.g., of about 40 tons). In this step, the modules 23, 25, 27 are reassembled into the modular production tree assembly 21 on the rig 34. At this stage, only interface testing (step 1211) is performed between the modules 23, 25, 27. After testing 1211, the tree assembly 21 is deployed to the sea floor 35 (step 1213) with a second crane 37 (e.g., the draw works) which also is mounted to the rig 34. The draw works 37 has a larger lift capacity than outrigger crane 33.

Figure 7:
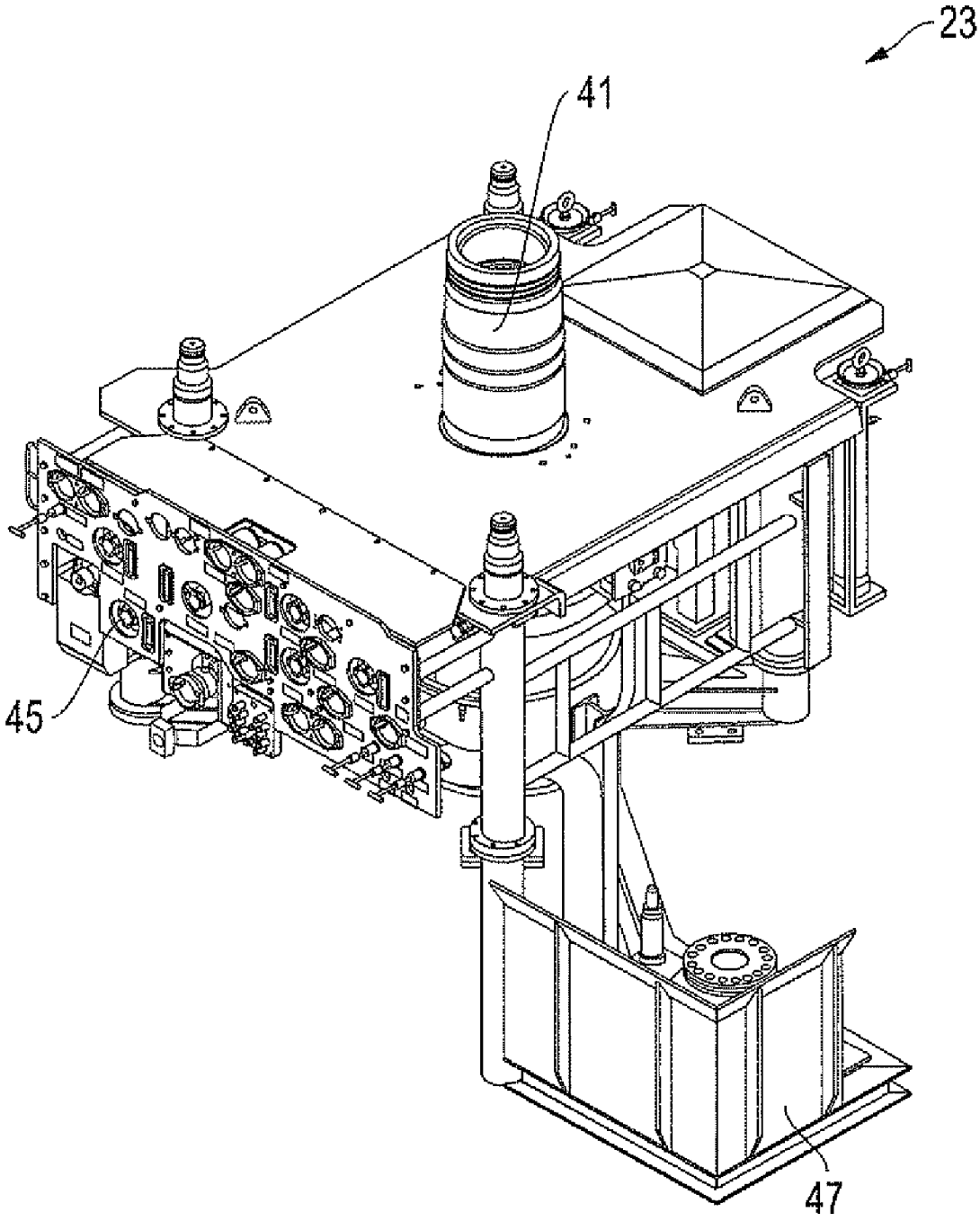
FIGS. 7 and 8 are opposite isometric views of one embodiment of an upper tree for the modular production tree assembly of FIG. 1 and is constructed in accordance with the invention.
Figure 8:
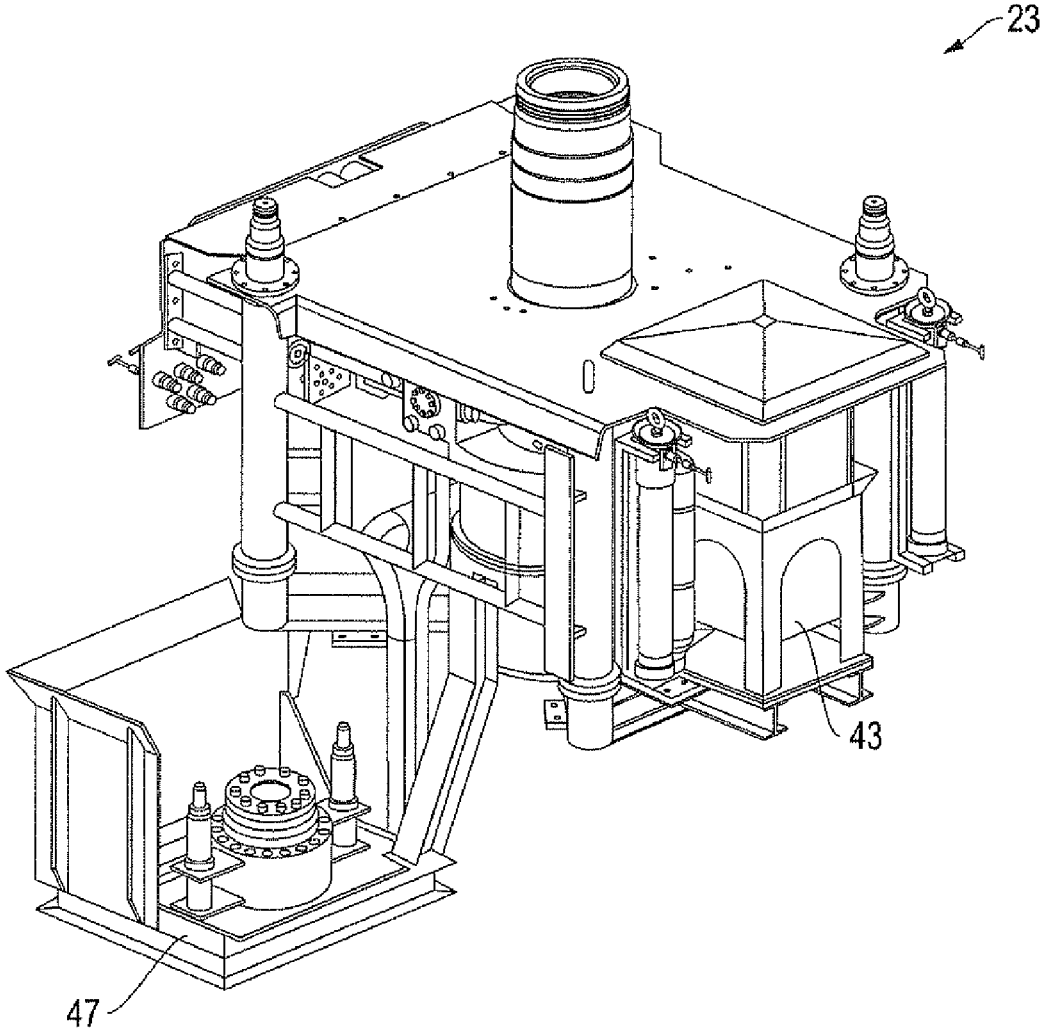

Referring again to FIGS. 1, 2, 7, 8 and 13, the upper tree module 23 may comprise a tree head 41 (FIG. 13), or tree head assembly, having a wellhead connector 61, a master valve block 63, a production wing block 65 and an annulus wing block 67. The upper tree module 23 further comprises a subsea control system 43 (FIG. 8) and a remotely operated vehicle, or ROV panel 45 (FIG. 7). The upper tree module 23 also has a choke module multi-bore connector 47 with support frame work and integral guideline or guideline-less interfaces for subsea change-out of the choke module 27.

In some embodiments, the treehead is the assembly name for all of the main pressure-containing components within a "tree", e.g., the wellhead connector, the central master valve block that contains all the master valves and downhole isolation valves, and then the two wing blocks that contain all secondary valves, pressure and temperature sensors and usually most of the chemical injection equipment.

The lower tree module 25 (FIGS. 1-6) may comprise a guidance system 51 for aligning with the upper tree module 23, counterweights 53 (for counterbalancing the final assembly), anodes for a cathodic protection system, and means for tying in flow lines to an in-field infrastructure 57. The lower tree module 25 also comprises a guideline-less, downward-facing funnel 55 (FIG. 4) to interface with a wellhead, a manifold/flowline connection system 57, associated pipe work for connection to the upper tree module via the choke bridge module, and a choke module multi-bore hub connection 59. The lower tree also can be pre-fitted with the cathodic protection system required for the entire tree assembly, which again reduces the weight of the other heavy modules.

Referring now to FIGS. 1, 2 and 9 -11, the choke bridge module 27 comprises a choke and instrumentation equipment (e.g., pressure and temperature sensors, flow meters, sand detectors, etc.) to link together the upper tree module 23, lower tree module 25, and choke bridge module 27 to form the tree assembly 21. For example, the choke bridge module 27 may comprise sensors 71,72, flow meters 73 and choke components 75,77 that are operated from the upper tree module 23 when the choke bridge module 27 is connected between the upper and lower tree modules 23, 25 to provide an integrated production tree system 21. This design allows some elements of the equipment on a single module so that, if it fails, it may be quickly and easily retrieved for repair, leaving the heavier and more cumbersome components subsea.

By placing the control system on the upper tree it can be hard-piped to the tree head. As a result there are reliable, pre-tested connections to the most complex module and also to the main safety flow control elements (i.e., the isolation valves). The control system is then piped/connected to the choke module through the multi-bore flow connection hub. This design again minimizes the number of connections that have to be made up on the rig, since these connections are automatically made up when the choke module is installed.

Since discrete modules are being used to make up the final tree assembly, any counterweights required (e.g., for a neutral center of gravity of the full assembly) may be installed on the lower module and still not exceed the 40 ton outrigger lift limit. As a result, the rig crew does not have to start adding extra counterweights to the tree when it is assembled on the rig. This configuration reduces the risk of accidents, time required for assembly and the risk of accidentally omitting components before lowering and installing the tree on the sea floor.

The lower tree may be configured to also act as both the shipping and inspection stand for the upper tree. This design avoids the need to take additional modules from the shore to the rig. For example, if a lower tree module is placed on the rig, the upper tree module can be lifted off the barge and landed directly onto the lower tree module on the rig. Access also can be provided through the lower tree module for change out of wellhead gaskets within the connector of the upper tree module. This design helps to reduce the space taken up on the rig floor by test and assembly equipment.

The invention has several advantages including a modular satellite tree design that combines the advantages of a separate flowbase with a well jumper. Tie-ins to the tree are provided into the singular assembly which saves rig time for installation as only a single trip is required to deploy the modular assembly.

Combining the three modular sub-assemblies of the tree, flowbase and choke bridge into a single assembly allows a single run for deployment and gains a number of advantages. For example, the rig time for deployment is reduced since only a single run is required. No additional connections are required between the tree and flowbase (since they are connected through the choke bridge).

The modular design allows easy break down to aid offshore transportation where rig lifts capacities may be limited. The invention also allows simple unitization and testing on the rig prior to deployment. The number of connections is reduced and therefore reduces potential leak paths. The choke bridge may be removed and installed later in field life to allow replacement of vulnerable items subject to high erosion.

Additional benefits include that no module exceeds the approximately 40 ton weight limit for most outrigger lifts on the offshore rigs. This is especially significant for deep water, large bore horizontal tree designs. The use of multi-bore connectors allows the choke bridge to be controlled from the tree-mounted control system (e.g., subsea control module or SCM) without the need for a separate hydraulic flying lead (HFL). The upper tree may be landed directly onto the lower tree (which is already on the rig) during rig transfer without the need to lift the upper tree with its dedicated shipping skid.

This design also eliminates bolted connections since it is simply aligned, stacked and clamped with pins, and it permits more flow and flexibility to connections. The tree sub-frame may be lifted onto the rig independent of the tree, and includes a jumper connector and multibore hub for the choke bridge module. The tree is lifted onto the rig independent of the sub-frame, and the tree and subframe are interfaced and made up together on the rig.

While the invention has been shown or described in only some of its forms, it should be apparent to those skilled in the art that it is not so limited, but is susceptible to various changes without departing from the scope of the invention.

What is claimed is:

1. A method of deploying a production tree to a sea floor, comprising:

(a) providing an upper tree module, a lower tree module, and a choke bridge module;

(b) assembling the upper tree module, the lower tree module, and the choke bridge module into operative engagement with each other on land to form a modular production tree assembly and testing the modular production tree assembly;

(c) after testing the modular production tree assembly, transporting the upper tree module, the lower tree module, and the choke bridge module to an offshore rig;

(d) separately lifting the upper tree module, the lower tree module, and the choke bridge module onto the offshore rig with a first crane mounted to the offshore rig;

(e) reassembling on the offshore rig the upper tree module, lower tree module and choke bridge module into the modular production tree assembly; then (f) performing interface testing of the modular production tree assembly of interfaces between the upper tree module, lower tree module and choke bridge module; and then (g) deploying the modular production tree assembly to the sea floor with a second crane mounted to the offshore rig.

2. A method according to claim 1, wherein the modular production tree assembly is disassembled after completing step (b) and prior to step (d).

3. A method according to claim 1, wherein the first crane comprises an outrigger crane, and the second crane comprises a draw works.

4. A method according to claim 1, wherein the upper tree module comprises a tree head and a subsea control system, and the lower tree module comprises a guidance system, counterweights and means for tying in flow lines to an in-field infrastructure.

5. A method according to claim 1, wherein the choke bridge module comprises a choke and instrumentation bridge to link together the upper tree module, the lower tree module, and the choke bridge module.

6. A method according to claim 1, wherein the upper tree module includes a treehead assembly, a wellhead connector, a subsea control system and a support frame work with integral guideline or guideline-less interfaces.

7. A method according to claim 1, wherein the lower tree module comprises a guideline-less, downward-facing funnel to interface with a wellhead, a manifold/flowline connection system, and associated pipe work for connection to the upper tree module via the choke bridge module.

8. A method according to Claim 1, wherein the choke bridge module comprises sensors, flow meters and choke components that are operated from the upper tree module when the choke bridge module is connected between the upper and lower tree modules.

9. A method of deploying a production tree to a sea floor, comprising:

(a) providing three modules, consisting of an upper tree module, a lower tree module, and a choke bridge module;

(b) assembling the upper tree module, the lower tree module, and the choke bridge module on land to define a modular production tree assembly and testing the modular production tree assembly on land;

(c) after testing the modular production tree assembly, loading the upper tree module, the lower tree module, and the choke bridge module onto a vessel and transporting the upper tree module, the lower tree module, and the choke bridge module to an offshore rig;

(d) disassembling the modular production tree assembly and separately lifting the upper tree module, lower tree module, and choke bridge module from the vessel onto the offshore rig with a first crane mounted to the offshore rig;

(e) reassembling the upper tree module, lower tree module and choke bridge module into the modular production tree assembly on the offshore rig; then (f) performing interface testing between the upper tree module, the lower tree module and the choke bridge module; and then (g) deploying the modular production tree assembly to the sea floor with a second crane mounted to the offshore rig.

10. A method according to claim 9, wherein the modular production tree assembly is disassembled in step (d) either on land, or on the vessel.

11. A method according to claim 9, wherein the first crane comprises an outrigger crane, and the second crane comprises a draw works.

12. A method according to claim 9, wherein the upper tree module comprises a tree head and a subsea control system, and the lower tree module comprises a guidance system, counterweights, a cathodic protection system, and means for tying in flow lines to an in-field infrastructure.

13. A method according to claim 9, wherein the choke bridge module comprises a choke and instrumentation bridge to link together the upper tree module, the lower tree module, and the choke bridge module.

14. A method according to claim 9, wherein the upper tree module includes a treehead assembly, a wellhead connector, a subsea control system, and a support frame work with integral guideline or guideline-less interfaces.

15. A method according to claim 9, wherein the lower tree module comprises a guideline-less, downward-facing funnel to interface with a wellhead, a manifold/flowline connection system, and associated pipe work for connection to the upper tree module via the choke bridge module.

16. A method according to claim 9, wherein the choke bridge module comprises sensors, flow meters and choke components that are operated from the upper tree module when the choke bridge module is connected between the upper and lower tree modules

17. A method of deploying a production tree to a sea floor, comprising:

(a) providing an upper tree module, a lower tree module, and a choke bridge module, the upper tree module comprising a tree head and a subsea control system, the lower tree module comprising a guidance system, counterweights, a cathodic protection system, and means for tying in flow lines to an in-field infrastructure, and the choke bridge module comprising a choke and an instrumentation bridge to link together the upper tree module, the lower tree module, and the choke bridge module;

(b) assembling the upper tree module, the lower tree module, and the choke bridge module on land to define a modular production tree assembly and testing the modular production tree assembly on land;

(c) transporting the upper tree module, the lower tree module, and the choke bridge module on a vessel to an offshore rig;

(d) disassembling the modular production tree assembly and separately lifting the upper tree module, the lower tree module, and the choke bridge module from the vessel onto the offshore rig with an outrigger crane mounted to the offshore rig;

(e) reassembling the upper tree module, the lower tree module and the choke bridge module into the modular production tree assembly on the offshore rig; then (f) performing only interface testing between the upper tree module, the lower tree module and the choke bridge module; and then (g) deploying the modular production tree assembly to the sea floor with a draw works mounted to the offshore rig.

18. A method according to claim 17, wherein the modular production tree assembly is disassembled in step (d) either on land or on the vessel.

19. A method according to claim 17, wherein the upper tree module includes a treehead assembly, a wellhead connector, and a support frame work with integral guideline or guideline-less interfaces, and the lower tree module comprises a guideline-less, downward-facing funnel to interface with a wellhead, a manifold/flowline connection system, and associated pipe work for connection to the upper tree module via the choke bridge module, and the choke bridge module comprises sensors, flow meters and choke components that are operated from the upper tree module when the choke bridge module is connected between the upper and lower tree modules.

* * * * *